US008209797B2

(12) United States Patent
Swierski et al.

(10) Patent No.: US 8,209,797 B2
(45) Date of Patent: Jul. 3, 2012

(54) DEPLOYABLE BED ASSEMBLY FOR USE WITH A CONVENTIONAL SOFA, CHAIR, OR THE LIKE

(76) Inventors: Scott T. Swierski, Waxhaw, NC (US); Dawn M. Swierski, Waxhaw, NC (US)

( * ) Notice: Subject to any disclaimer, the term of this patent is extended or adjusted under 35 U.S.C. 154(b) by 448 days.

(21) Appl. No.: 12/504,455

(22) Filed: Jul. 16, 2009

(65) Prior Publication Data

US 2010/0011500 A1 Jan. 21, 2010

Related U.S. Application Data

(60) Provisional application No. 61/081,617, filed on Jul. 17, 2008.

(51) Int. Cl.
*A47C 17/22* (2006.01)

(52) U.S. Cl. ..... 5/1; 5/2.1; 5/30; 5/49

(58) Field of Classification Search ..... 5/1, 2.1, 5/7, 12.1, 30, 49, 50, 507.1
See application file for complete search history.

(56) References Cited

U.S. PATENT DOCUMENTS

| | | | | |
|---|---|---|---|---|
| 4,990 | A | 7/1872 | Crosby | |
| 145,404 | A | 12/1873 | Donieg et al. | |
| 1,618,737 | A * | 2/1927 | Turner | 5/12.1 |
| 1,926,915 | A * | 9/1933 | Ramirez | 297/109 |
| 3,064,278 | A * | 11/1962 | Broyles | 5/184 |
| 3,867,730 | A | 2/1975 | Wright | |
| 4,106,137 | A | 8/1978 | Leclerc | |
| 4,205,405 | A | 6/1980 | Hagney | |
| 4,442,556 | A | 4/1984 | Craigie | |
| 4,628,551 | A | 12/1986 | Atimichuk | |
| 4,651,362 | A | 3/1987 | Alperin et al. | |
| 6,739,651 | B1 | 5/2004 | Barefoot | |
| 7,376,987 | B2 * | 5/2008 | Barnes | 5/93.2 |

* cited by examiner

*Primary Examiner* — Frederick Conley

(57) ABSTRACT

The present disclosure relates to a deployable bed assembly and associated method for using the deployable bed assembly with a conventional sofa, chair, and the like. The deployable bed is configured to rest upon and/or connect to the conventional sofa, chair, and the like with the conventional sofa, chair, and the like providing support and acting as a head board.

7 Claims, 18 Drawing Sheets

DEPLOYABLE BED ASSEMBLY FOR USE WITH A CONVENTIONAL SOFA, CHAIR, OR THE LIKE

CROSS-REFERENCE TO RELATED APPLICATION(S)

The present non-provisional patent application/patent claims the benefit of priority of U.S. Provisional Patent Application No. 61/081,617, filed on Jul. 17, 2008, and entitled "DEPLOYABLE BED ASSEMBLY FOR USE WITH A CONVENTIONAL SOFA, CHAIR, OR THE LIKE," the contents of which are incorporated in full by reference herein.

FIELD OF THE INVENTION

The present invention relates generally to a deployable bed assembly for use with a conventional sofa, chair, or the like. More particularly, the present invention relates to a deployable bed assembly that is deployed in conjunction with a separate conventional sofa, chair, or the like.

BACKGROUND OF THE INVENTION

Conventionally, sofa-bed assemblies fall into one of three categories—sofa-beds, day-beds, and futons. Sofa-beds contain a mattress disposed within a sofa that is deployable to convert the sofa to a bed. Day-beds contain a frame structure that enables a bed to double as a sofa with the addition of pillows, cushions, or the like. Finally, futons include a movable frame that enables a cushion to double as both a sofa and a bed based on the frame position. Of note, each of these assemblies are specifically manufactured to support both a bed and a sofa configuration. Existing sofas, couches, chairs, and the like that are not manufactured to double as a bed cannot be converted into a bed. Also, existing folding bed assemblies exist that provide a free-standing bed that can be collapsed to store the bed when not in use. Disadvantageously, such folding bed assemblies utilize complex folding mechanisms since these beds must support significant weights. What has yet to be investigated is a deployable bed assembly that can be utilized with a conventional sofa, chair, etc.

BRIEF SUMMARY OF THE INVENTION

In various exemplary embodiments, the present invention relates to a deployable bed assembly and associated method for using the deployable bed assembly with a conventional sofa, chair, and the like. The deployable bed is configured to rest upon and/or connect to the conventional sofa, chair, and the like with the conventional sofa, chair, and the like providing support and acting as a head board. Of note, the deployable bed is configured to interconnect with existing sofas, chairs, etc. through deployable paddle structures thereby enabling the deployable bed to work with any sofa, chair, etc.

In an exemplary embodiment of the present invention, a deployable bed assembly for use with a conventional piece of furniture includes a frame assembly; and one or more deployable paddle structures disposed at an end of the frame assembly, wherein the one or more deployable paddle structures are configured to interconnect the frame assembly with the conventional piece of furniture and wherein the conventional piece of furniture provides support for the frame assembly. The deployable bed assembly further includes a deployable mattress supported by the frame assembly. The deployable mattress includes one of an air mattress, a foam mattress, a filled mattress, an innerspring mattress, a water mattress, and a pad. The deployable bed assembly further includes a plurality of legs movably disposed to the frame assembly, wherein the plurality of legs are configured for adjustable height of the frame assembly based on the conventional piece of furniture. The frame assembly includes a plurality of subassemblies, and wherein the one or more deployable paddle structures are hingedly connected to one of the plurality of subassemblies. The plurality of subassemblies are rotatably interconnected to one another thereby enabling the frame assembly to deploy into a deployed configuration and to store in a stowed configuration. The plurality of subassemblies connected to an additional frame assembly with an additional plurality of subassemblies to form a larger deployable bed. The conventional piece of furniture includes any of a sofa, a chair, and a love seat, and wherein the conventional piece of furniture does not include a deployable sofa bed at a time of manufacture.

In another exemplary embodiment of the present invention, a method for deploying a bed assembly on a conventional piece of furniture includes deploying a frame assembly; deploying one or more deployable paddle structures from the frame assembly; and positioning the one or more deployable paddle structures between cushions and a back of the conventional piece of furniture thereby interconnecting the bed assembly to the conventional piece of furniture, wherein the conventional piece of furniture provides support for the bed assembly. The method further includes deploying one or more legs from the frame assembly; and adjusting heights of the one or more legs as required for the conventional piece of furniture. The method further includes deploying a mattress including one of an air mattress, a foam mattress, a filled mattress, an innerspring mattress, a water mattress, and a pad. The method further includes removing the one or more deployable paddle structures from the conventional piece of furniture; stowing the one or more deployable paddle structures; and stowing the frame assembly.

In yet another exemplary embodiment of the present invention, a piece of furniture with a removable bed assembly includes an existing piece of furniture; a frame assembly; and one or more deployable paddle structures disposed at an end of the frame assembly, wherein the one or more deployable paddle structures are configured to interconnect the frame assembly with the existing piece of furniture and wherein the existing piece of furniture provides support for the frame assembly; wherein the existing piece of furniture is separate and not permanently connected to the frame assembly. The piece of furniture with a removable bed assembly further includes a deployable mattress supported by the frame assembly. The deployable mattress includes one of an air mattress, a foam mattress, a filled mattress, an innerspring mattress, a water mattress, and a pad. The piece of furniture with a removable bed assembly further includes a plurality of legs movably disposed to the frame assembly, wherein the plurality of legs are configured for adjustable height of the frame assembly based on the existing piece of furniture. The frame assembly includes a plurality of subassemblies, and wherein the one or more deployable paddle structures are hingedly connected to one of the plurality of subassemblies. The plurality of subassemblies are rotatably interconnected to one another thereby enabling the frame assembly to deploy into a deployed configuration and to store in a stowed configuration. The plurality of subassemblies connected to an additional frame assembly with an additional plurality of subassemblies to form a larger deployable bed. The existing piece of furniture includes any of a sofa, a chair, and a love seat, and wherein the existing piece of furniture does not include a deployable sofa bed at a time of manufacture.

BRIEF DESCRIPTION OF THE DRAWINGS

The present invention is illustrated and described herein with reference to the various drawings, in which like reference numbers denote like system components, respectively, and in which.

DETAILED DESCRIPTION OF THE INVENTION

In various exemplary embodiments, the present invention relates to a deployable bed assembly and associated method for using the deployable bed assembly with a conventional sofa, chair, and the like. The deployable bed is configured to rest upon and/or connect to the conventional sofa, chair, and the like with the conventional sofa, chair, and the like providing support and acting as a head board. Of note, the deployable bed is configured to interconnect with existing sofas, chairs, etc. through deployable paddle structures thereby enabling the deployable bed to work with any sofa, chair, etc.

Figure 1:
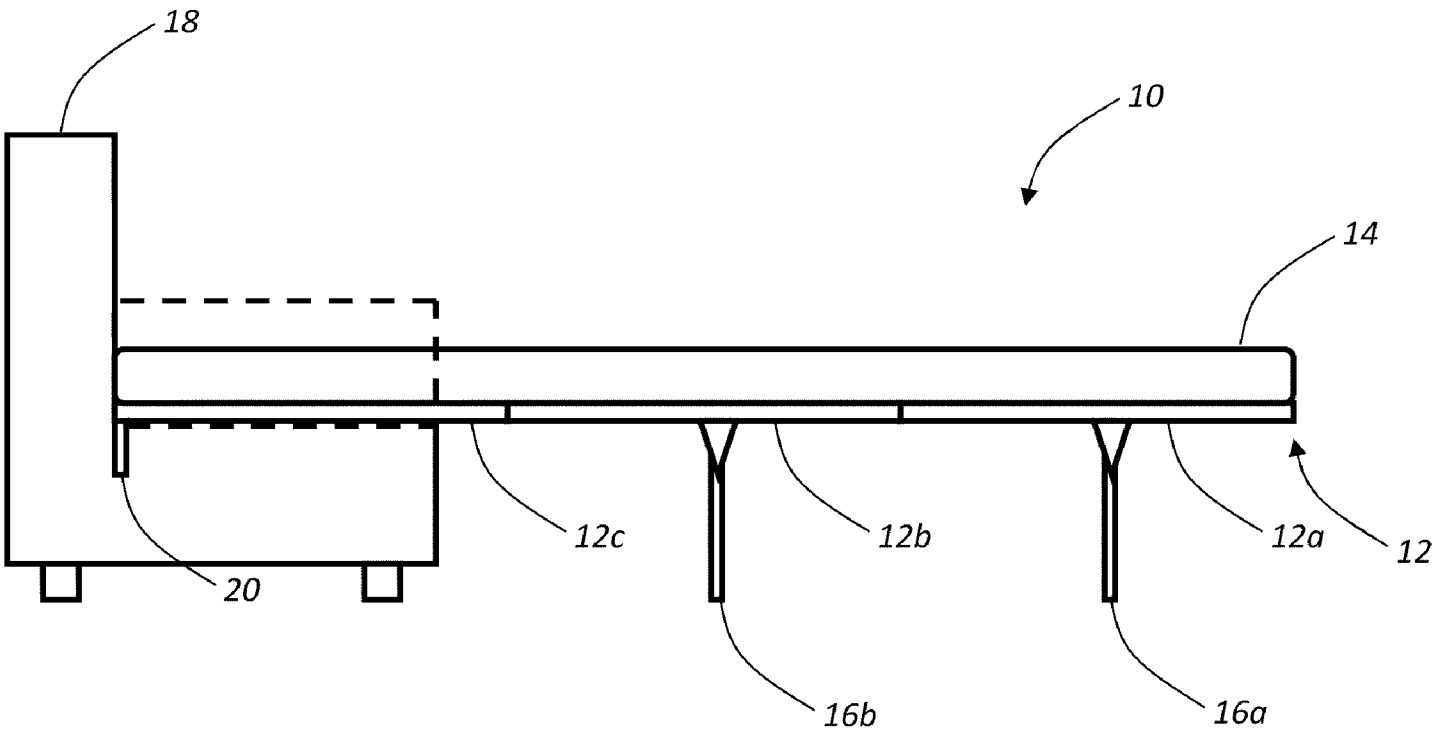
FIG. 1 is a schematic diagram illustrating one exemplary embodiment of the deployable bed assembly of the present invention in a fully deployed state.

Referring to FIG. 1, in one exemplary embodiment of the present invention, the deployable bed assembly 10 includes a frame assembly 12, including multiple frame subassemblies 12*a*, 12*b*, and 12*c*, and a deployable mattress 14. Although three frame subassemblies 12*a*, 12*b*, and 12*c* are illustrated and described here, it will be readily apparent to those of ordinary skill in the art that others numbers of frame subassemblies may also be utilized. Preferably, the frame subassemblies 12*a*, 12*b*, and 12*c* are jointed, such that they selectively fold together. Alternatively, the frame subassemblies 12*a*, 12*b*, and 12*c* are connectable, such that they are selectively connected together. Given frame subassemblies 12*a* and 12*b* include deployable legs 16*a* and 16*b* that are selectively deployed, either manually or automatically, to support the frame assembly 12. These deployable legs 16*a* and 16*b* may retract in any direction and/or manner that is convenient for compact storage. One frame subassembly 12*c* is configured to rest at least partially on the cushion(s) or base of a conventional sofa, chair, or the like (collectively 18), and includes one or more deployable paddle structures 20 that are selectively deployed, either manually or automatically, to engage and secure the frame assembly 12 to the conventional sofa, chair, or the like (collectively 18). It will be readily apparent to those of ordinary skill in the art that other mechanisms may also be utilized to engage and secure the frame assembly 12 to the conventional sofa, chair, or the like (collectively 18). Preferably, the deployable mattress 14 is an air mattress that is selectively inflated. Alternatively, the deployable mattress 14 is a foam mattress, a filled mattress, an innerspring mattress, a water mattress, a pad, or the like.

Figure 2:
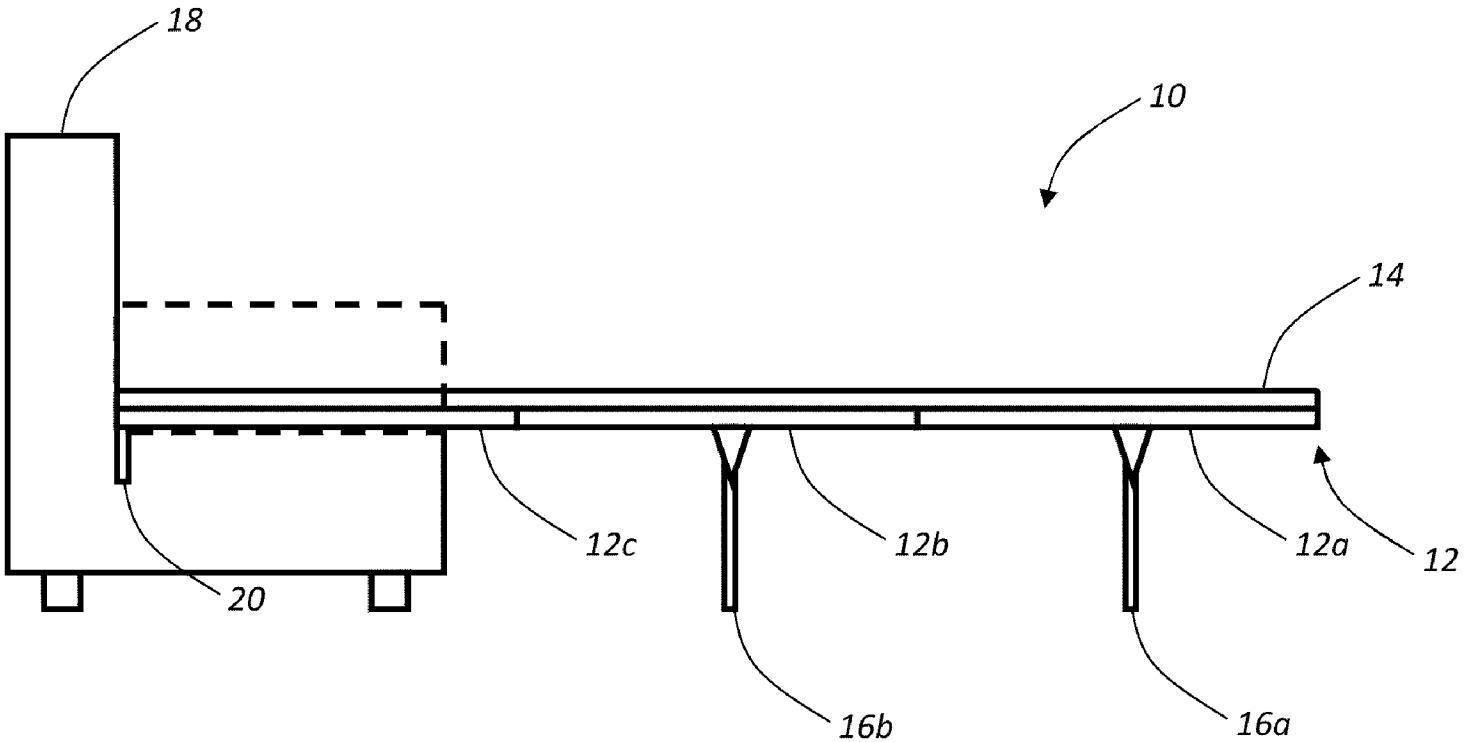
FIG. 2 is a schematic diagram illustrating the deployable bed assembly of FIG. 1 in a partially deployed state.
Figure 3:
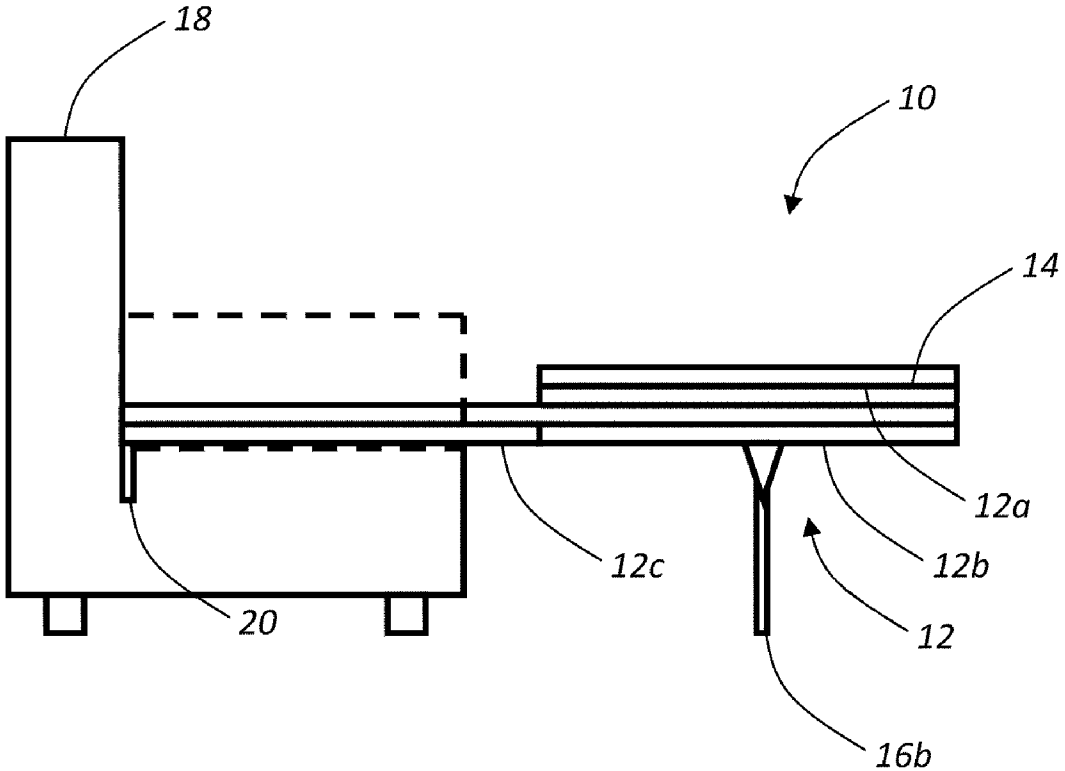
FIG. 3 is a schematic diagram illustrating the deployable bed assembly of FIGS. 1 and 2 in a partially deployed state.
Figure 4:
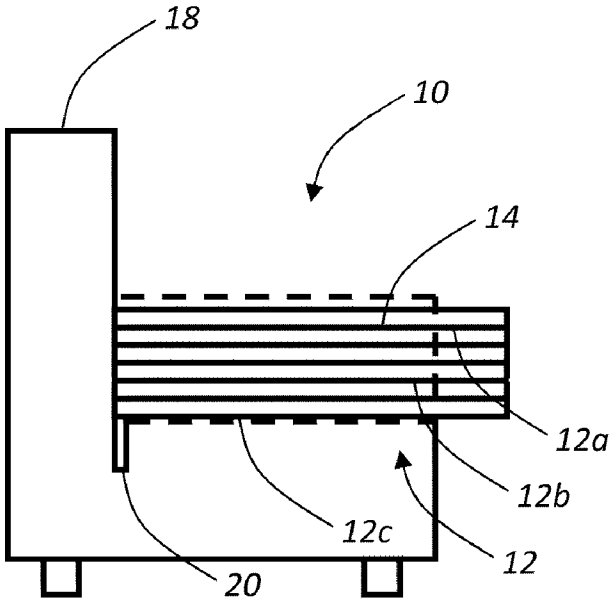
FIG. 4 is a schematic diagram illustrating the deployable bed assembly of FIGS. 1-3 in a partially deployed state.
Figure 5:
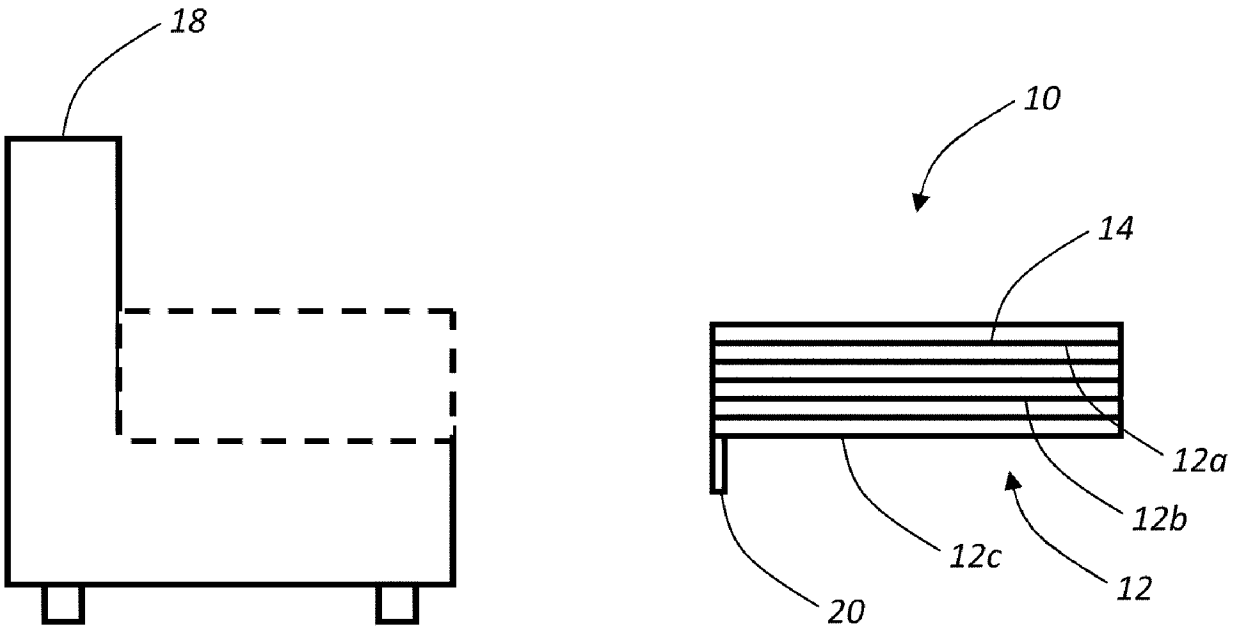
FIG. 5 is a schematic diagram illustrating the deployable bed assembly of FIGS. 1-4 in a partially deployed state.
Figure 6:
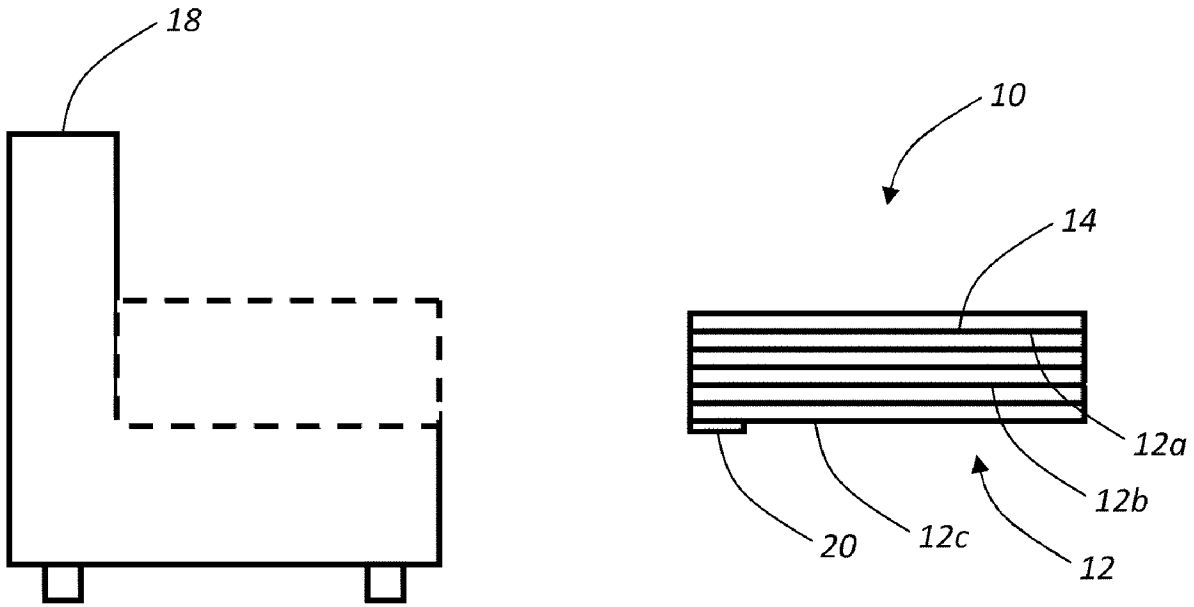
FIG. 6 is a schematic diagram illustrating the deployable bed assembly of FIGS. 1-5 in a fully stowed state.

Referring to FIGS. 2-6, the deployable bed assembly 10 is illustrated as the deployable bed assembly 10 is stowed and removed from the conventional sofa, chair, or the like (collectively 18). In FIG. 2, the deployable bed assembly 10 is illustrated with the deployable mattress 14 in a deflated state (assuming the deployable mattress 14 is a selectively inflatable air mattress). In FIG. 3, the deployable leg 16*a* is stowed and the frame subassembly 12*a* is folded on the frame subassembly 12*b*. In FIG. 4, the deployable leg 16*b* is stowed and the frame subassemblies 12*a*, 12*b* are folded on the frame subassembly 12*c* such that each of the frame subassemblies 12*a*, 12*b*, 12*c* rest upon one another. In FIG. 5, the deployable bed assembly 10 is removed from the conventional sofa, chair, or the like (collectively 18) by removing the one or more deployable paddle structures 20 from the conventional sofa, chair, or the like (collectively 18). FIG. 6 illustrates the deployable bed assembly 10 of FIGS. 1-5 in a fully stowed state. Here, the one or more deployable paddle structures 20 are folded into the frame subassembly 12*c* such that the deployable bed assembly 10 is in a stowable configuration. Optionally, the deployable bed assembly 10 can be placed in a bag or a cover can be placed over the deployable bed assembly 10, and the deployable bed assembly 10 can be stored for future use.

Advantageously, the deployable bed assembly 10 (FIGS. 1-6) is modular in nature, and may be selectively set up with and removed from the conventional sofa, chair, or the like (collectively 18) (FIGS. 1-6). The deployable bed assembly 10 eliminates the need for purchasing expensive, heavy, and bulky sofa-beds or the like, i.e. the deployable bed assembly 10 utilizes an existing piece of furniture in the conventional sofa, chair, or the like (collectively 18) to provide support and a head board. This further enables the conventional sofa, chair, or the like (collectively 18) to act as a sofa-bed without having been manufactured with an integral bed or frame.

Figure 7:
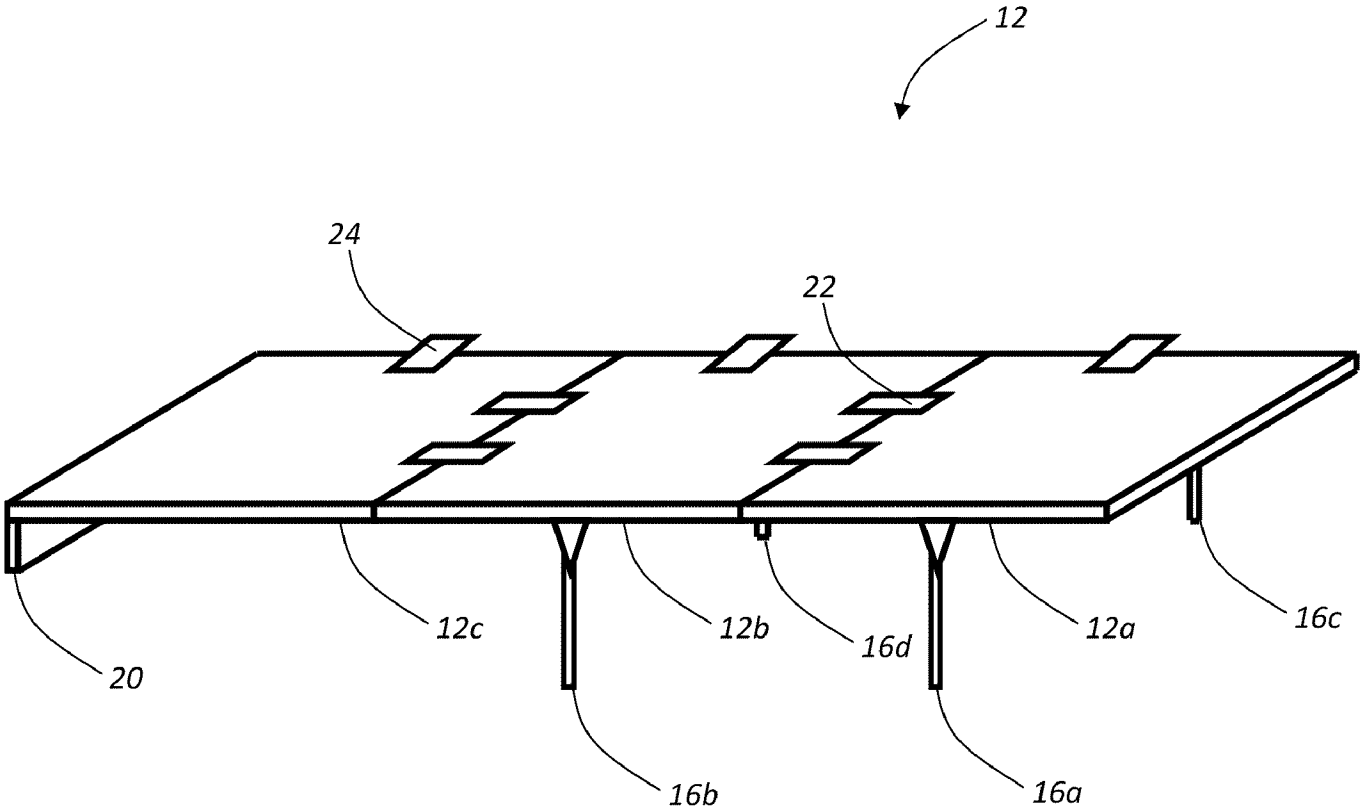
FIG. 7 is a schematic perspective diagram illustrating the frame assembly of the deployable bed assembly of FIG. 1 in a fully deployed state.

Referring to FIG. 7, in one exemplary embodiment of the present invention, the frame assembly 12, including the multiple frame subassemblies 12*a*, 12*b*, and 12*c*, is illustrated in a perspective view without the deployable mattress 14. As described herein, the frame assembly 12 includes the three multiple frame subassemblies 12*a*, 12*b*, and 12*c* (or more or less subassemblies). Each of the frame subassemblies 12*a*, 12*b*, and 12*c* can be interconnected through hinges 22, locks, hooks, or the like. Also, the frame subassemblies 12*a*, 12*b*, and 12*c* can include connectors 24 that may be used to connect the frame subassemblies 12*a*, 12*b*, and 12*c* to another set of frame subassemblies 12*a*, 12*b*, and 12*c*. For example, the frame assembly 12 may be a twin bed configuration that connects through the one or more deployable paddle structures 20 to a chair. Connecting a second frame assembly 12 through the connectors 24 can provide a double/queen bed configuration that connects through the one or more deployable paddle structures 20 to a love seat or couch. Also, connecting a third frame assembly 12 through the connectors 24 can provide a king bed configuration that connects rough the one or more deployable paddle structures 20 to a full couch or the like. Further, the deployable legs 16*a*, 16*b*, 16*c*, 16*d* also include an adjustments mechanism such as a screw or a sliding member with a pin that allows the frame assembly 12 to be at a variable height based on the requirements for the furniture that the one or more deployable paddle structures 20 interconnect with.

Figure 8A:
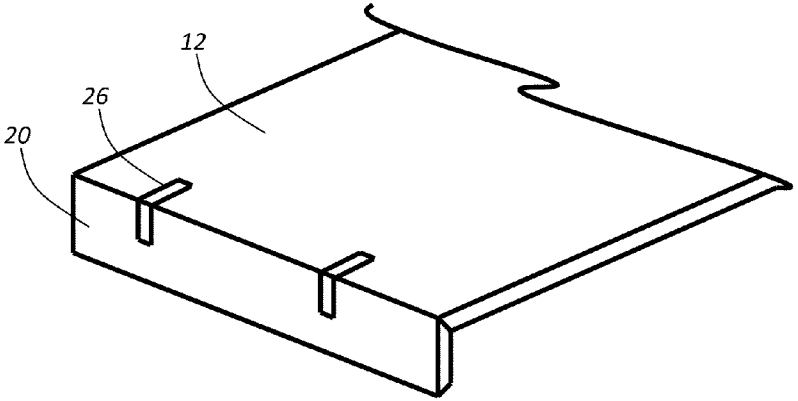
FIGS. 8*a*-8*c* are schematic perspective diagrams illustrating the frame assembly and one or more deployable paddle structures for interconnecting with a piece of furniture.
Figure 8B:
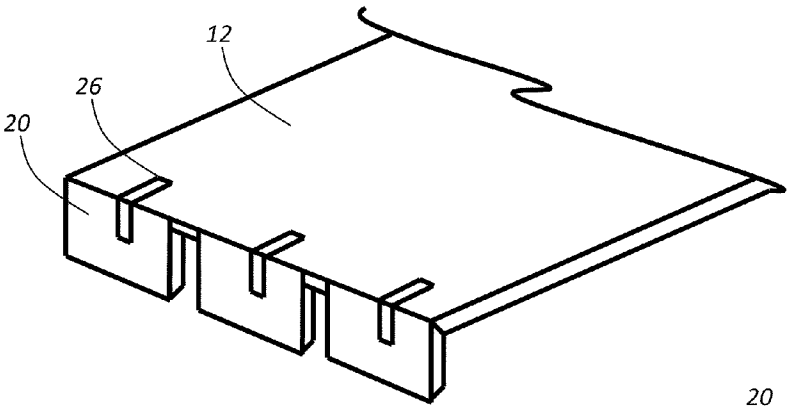
Figure 8C:
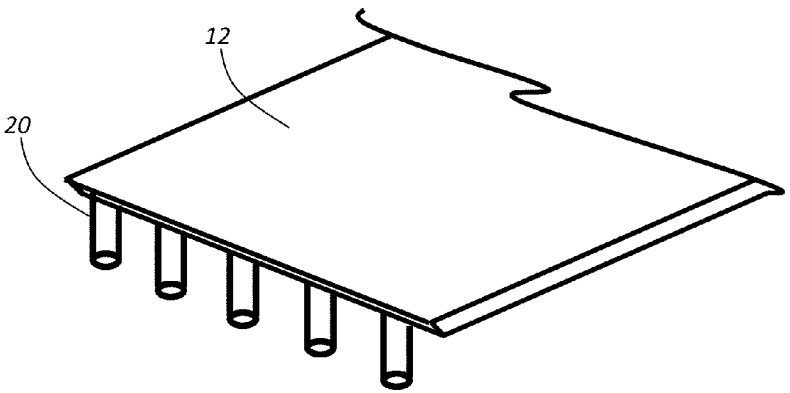

Referring to FIGS. 8*a*-8*c*, in one exemplary embodiment of the present invention, the frame assembly 12, including the one or more deployable paddle structures 20, is illustrated in a perspective view. The one or more deployable paddle structures 20 are selectively deployed, either manually or automatically, to engage and secure the frame assembly 12 to the conventional sofa, chair, or the like. Specifically, the one or more deployable paddle structures 20 can fold towards the frame assembly 12 through hinges 26 or the like in a stowed configuration. When deployed, the one or more deployable paddle structures 20 are configured to be placed between a cushion and a back of a piece of furniture thereby engaging the frame assembly 12 to the piece of furniture. For example, a couch typically includes multiple cushions for sitting and a couch frame. The one or more deployable paddle structures 20 fit at the back of the cushions between the cushions and the couch frame. The frame assembly 12 is thereafter supported by the cushions with the couch frame providing a head board. If the piece of furniture has cushions that are not removable or if there is no space for the one or more deployable paddle structures 20 between the cushions and the couch frame, the frame assembly 12 can be deployed on the cushions with the one or more deployable paddle structures 20 in the stowed configuration. Also, the one or more deployable paddle structures 20 can include padding or the like and rounded edges such that the one or more deployable paddle structures 20 do not damage the associated piece of furniture that they interconnect with. FIG. 8*a* illustrates the one or more deployable paddle structures 20 as a single component that rotates about the hinge 26. FIG. 8*b* illustrates the one or more deployable paddle structures 20 as three components that each rotate about the hinge 26. FIG. 8*c* illustrates the one or more deployable paddle structures 20 as a plurality of rods that are disposed to the frame assembly. The plurality of rods may fold, detach, or retract for stowing with the frame assembly 12. Additionally, the one or more deployable paddle structures 20 can be fixedly attached to a corresponding structure on the furniture. For example, the plurality of rods could fit into a plurality of receiving holes disposed within the furniture.

Figure 9B:
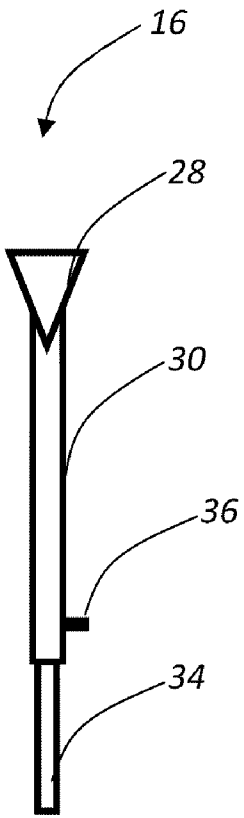
FIGS. 9*a* and 9*b* are schematic diagrams of a deployable leg that is connected to the frame assembly.
Figure 9A:
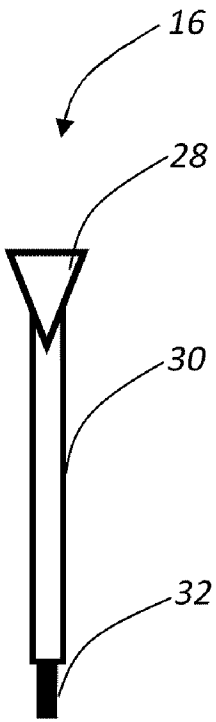

Referring to FIGS. 9*a* and 9*b*, in one exemplary embodiment of the present invention, the deployable leg 16 is illustrated for the frame assembly 12. Since the frame assembly 12 is utilized with existing furniture, the frame assembly 12 has to support variable heights based on the existing furniture. Specifically, the deployable legs 16 are configured to provide a variable height for the frame assembly 12 and thus for the deployable bed assembly 10 thereby enabling use with any sized couch, chair, etc. In FIG. 9*a*, the deployable leg 16 is illustrated with a hinge 28, a leg member 30, and an adjustment mechanism 32. In FIG. 9*b*, the deployable leg 16 is illustrated with a hinge 28, a leg member 30, a second leg member 34, and a locking pin 36. The hinge 28 connects the deployable leg 16 to the frame assembly 12 and enables the deployable leg 16 to fold into a stowed position on the frame assembly 12. The leg member 30 extends from the hinge 28. The adjustment mechanism 32 can include a screw that allows for variable height based on the position of the screw. The second leg member 34 slides within the leg member 30 and can be locked in a plurality of positions based on the locking pin 36. Note, both of these variable height mechanisms can be utilized together with the adjustment mechanism 32 providing minor height adjustments and the second leg member 34 providing major height adjustments.

Figure 10C:
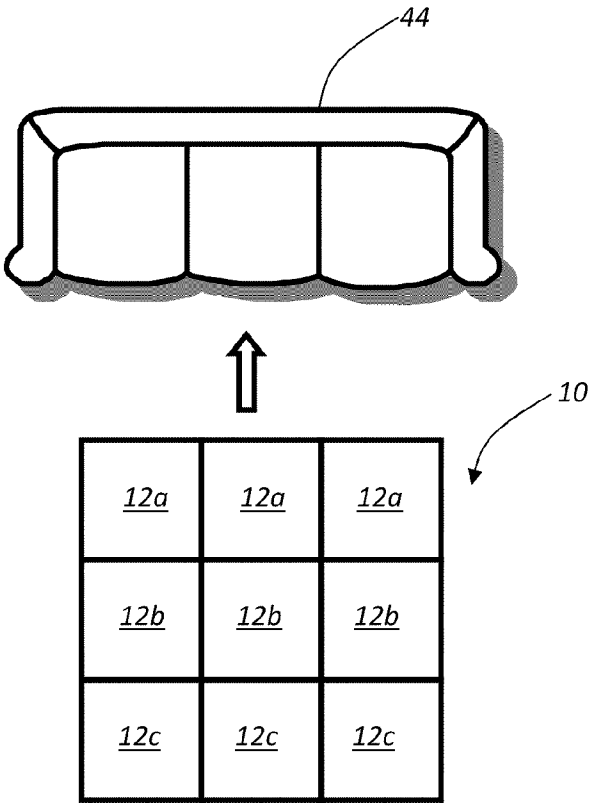
FIGS. 10*a*-10*c* are schematic diagrams of illustrating the deployable bed assembly with a chair, a love seat and a couch.
Figure 10B:
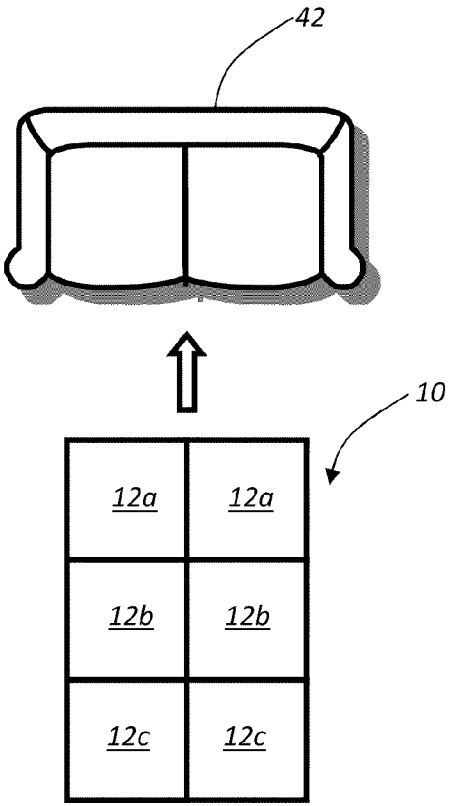
Figure 10A:
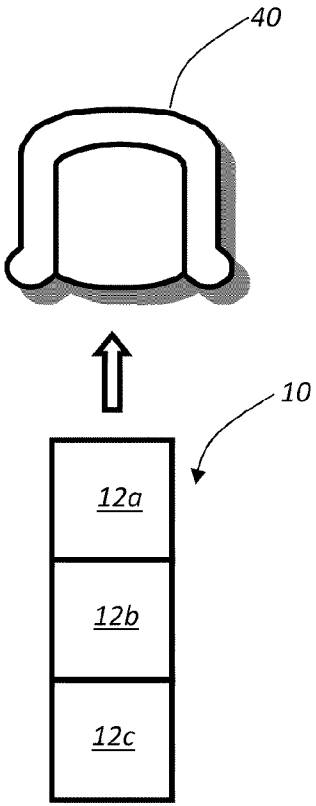

Referring to FIGS. 10*a*-10*c*, in various exemplary embodiments of the present invention, the deployable bed assembly 10 is illustrated with a chair 40, a love seat 42, and a couch 44. In this configuration, the frame assembly 12 is shown interconnecting with the chair 40 in FIG. 10*a*. A second frame assembly 12 is connected through the connectors 24 or the like, and the double frame assembly 12 is interconnecting with the love seat 42 in FIG. 10*b*. Finally, a third frame assembly 12 is connected through the connectors 24 or the like, and the triple frame assembly 12 is interconnecting with the couch 44 in FIG. 10*c*.

Figure 11B:
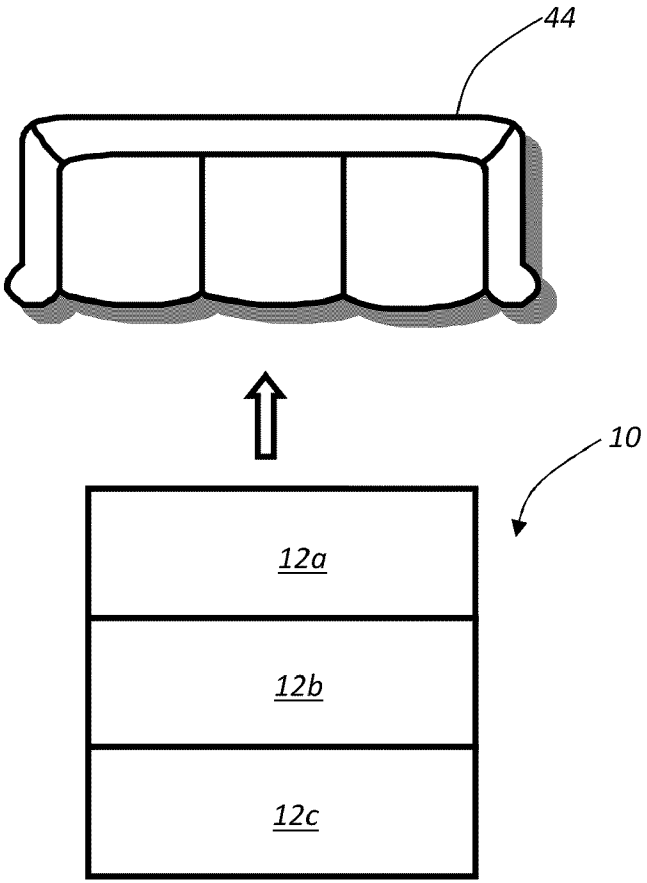
FIGS. 11*a* and 11*b* are schematic diagrams of illustrating the deployable bed assembly with a love seat and a couch.
Figure 11A:
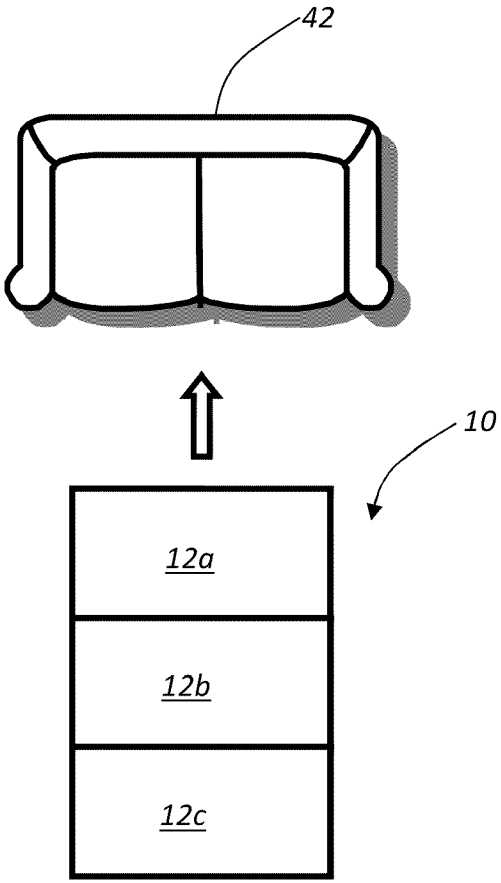

Referring to FIGS. 11*a* and 11*b*, in further exemplary embodiments of the present invention, the deployable bed assembly 10 is illustrated with the love seat 42 and the couch 44. Here, the deployable bed assembly 10 is not formed through interconnecting additional frame assemblies 12. Rather, the deployable bed assembly 10 is formed as a single frame assembly 12 for both the love seat 42 (FIG. 11*a*) and the couch 44 (FIG. 11*b*).

Figure 12:
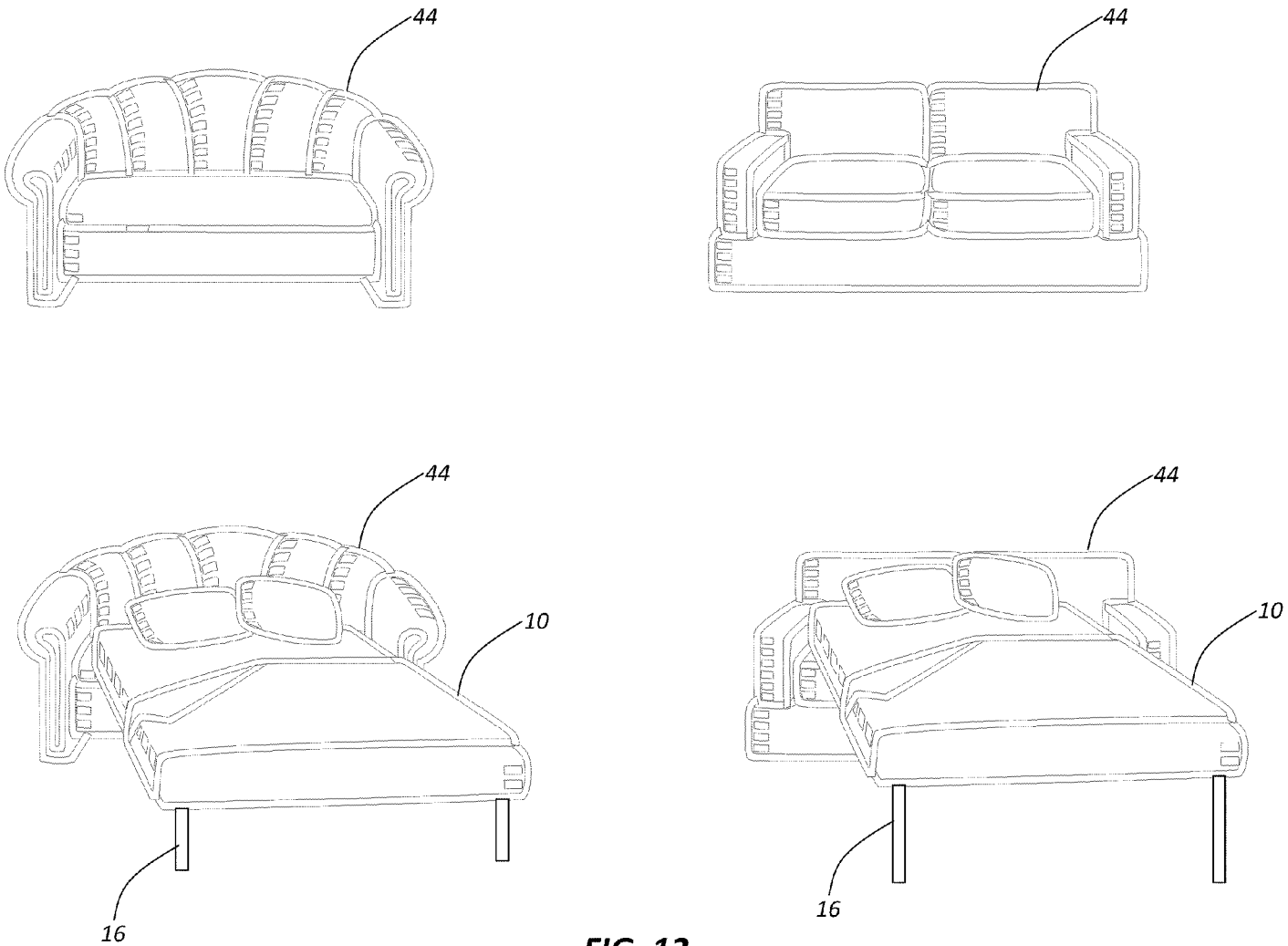
FIG. 12 is a schematic perspective diagram illustrating the deployable bed assembly different couches.

Referring to FIG. 12, in yet another exemplary embodiment of the present invention, the deployable bed assembly 10 is illustrated with two different couches 44. Here, the same deployable bed assembly 10 can be utilized by simply adjusting the height of the deployable legs 16 based on the couches 44.

Figure 13:
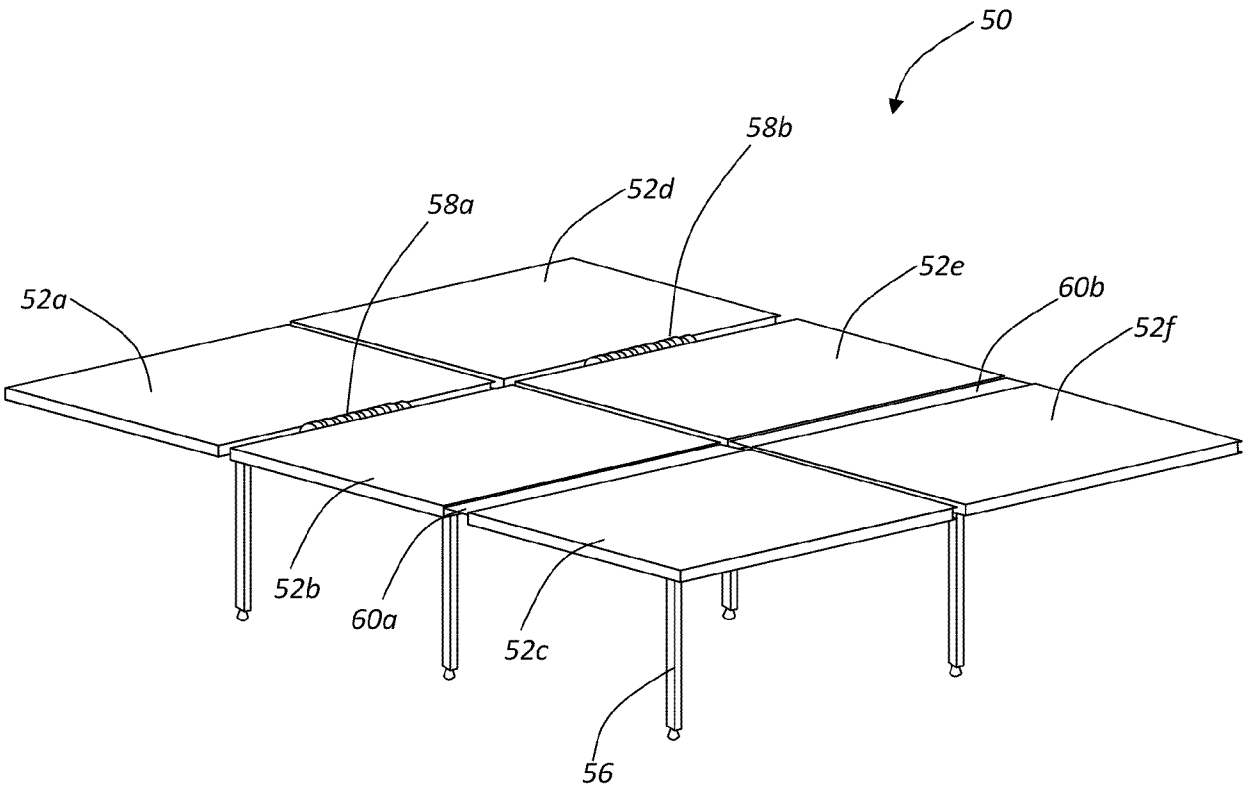
FIG. 13 is a schematic perspective diagram illustrating a frame assembly for a deployable bed assembly.
Figure 14:
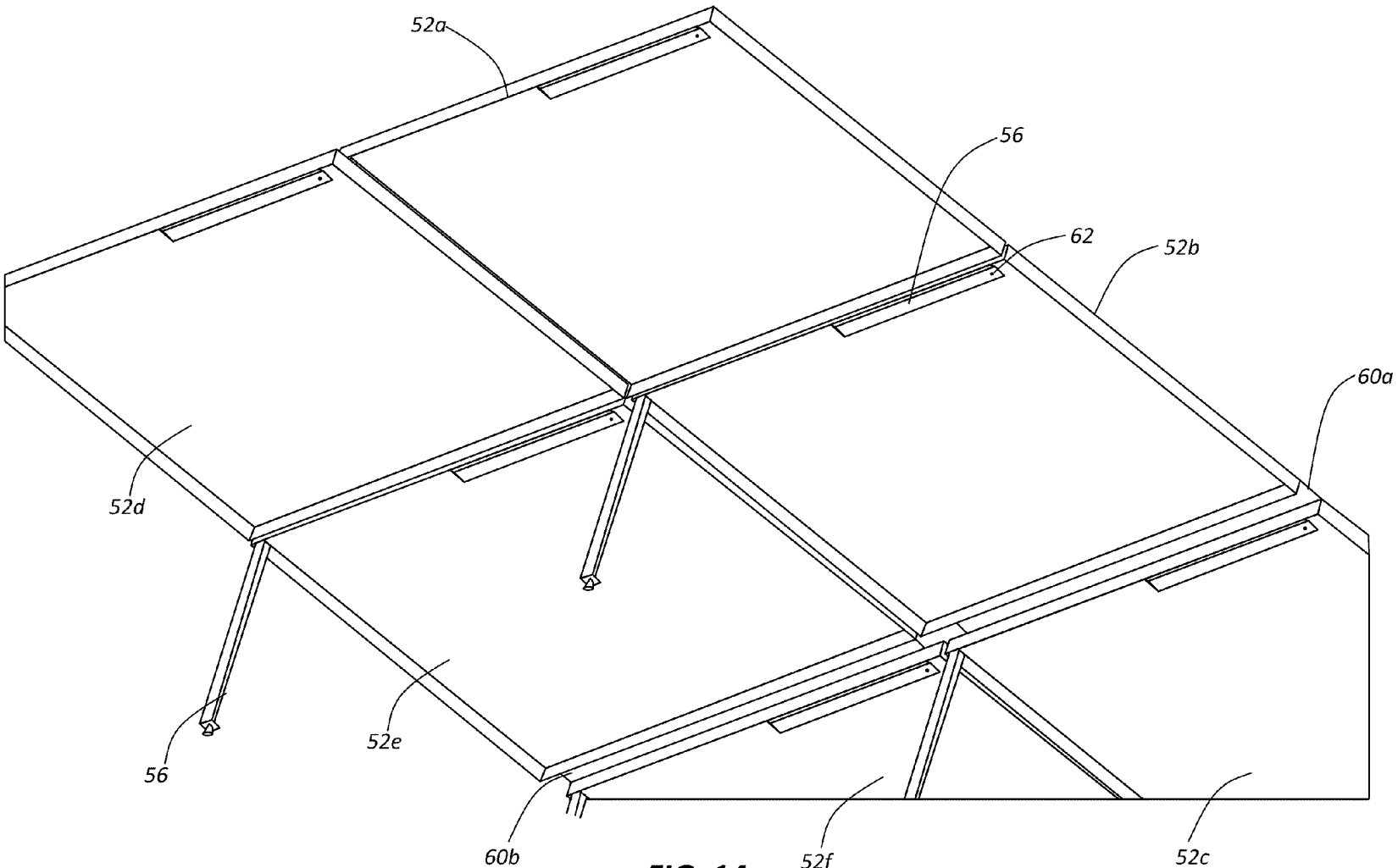
FIG. 14 is a schematic perspective diagram illustrating a bottom view of the frame assembly of FIG. 13.

Referring to FIGS. 13-18, a frame assembly 50 is illustrated in various perspective views for use with the deployable bed assembly 10 according to an exemplary embodiment of the present invention. Referring to FIGS. 13-14, FIG. 13 illustrates a perspective top view and FIG. 14 illustrates a perspective bottom view of the frame assembly 18. The frame assembly 50 includes six subassemblies 52*a*, 52*b*, 52*c*, 52*d*, 52*e*, and 52*f*. The subassemblies 52*a*, 52*b*, and 52*c* are configured to detach from the subassemblies 52*d*, 52*e*, and 52*f* through a plurality of connectors 54 (illustrated in FIG. 17). The connectors 54 can include a pin in one of the subassemblies that mates with a hole in another subassembly or the like. Further, the subassemblies 52*a*, 52*b*, and 52*c* and the subassemblies 52*d*, 52*e*, and 52*f* are configured to stow from a plane (i.e., flat) configuration as shown in FIGS. 13-18 to a cube for storage. Specifically, the subassembly 52*a* is rotatably connected to the subassembly 52*b* through a hinge 58*a* and the subassembly 52*b* is connected to the subassembly 52*c* through a folding joint 60*a*. Conversely, the subassembly 52*d* is rotatably connected to the subassembly 52*e* through a hinge 58*b* and the subassembly 52*e* is connected to the subassembly 52*f* through a folding joint 60*b*. Note, the subassemblies 52*a*, 52*b*, 52*c*, 52*d*, 52*e*, and 52*f* can be stowed while the subassemblies 52*a*, 52*b*, and 52*c* are connected to the subassemblies 52*d*, 52*e*, and 52*f*, or while the subassemblies 52*a*, 52*b*, 52*c*, 52*d*, 52*e*, and 52*f* are disconnected.

Additionally, each of the subassemblies 52*a*, 52*b*, 52*c*, 52*d*, 52*e*, and 52*f* include a plurality of deployable legs 56. Specifically, FIG. 13 illustrates several deployable legs 56 in a deployed configuration and several deployable legs 56 in a stowed configuration (such as the deployable legs 56 for subassembly 52*a*, 52*f*). FIG. 14 illustrates a bottom view of the subassemblies 52*a*, 52*b*, 52*c*, 52*d*, 52*e*, and 52*f* showing the deployable legs 56 both in a deployed (e.g., on the subassembly 52*e*) and stowed configuration (e.g., on the subassembly 52*b*). In an exemplary embodiment, the deployable legs 56 include a hinge 62 whereby the deployable legs 56 can rotate by approximately 90 degrees to either be parallel to the subassembly 52 (stowed configuration) or perpendicular to the subassembly 52 (deployed configuration). Other mechanisms are also contemplated for the deployable legs 56.

Figure 15:
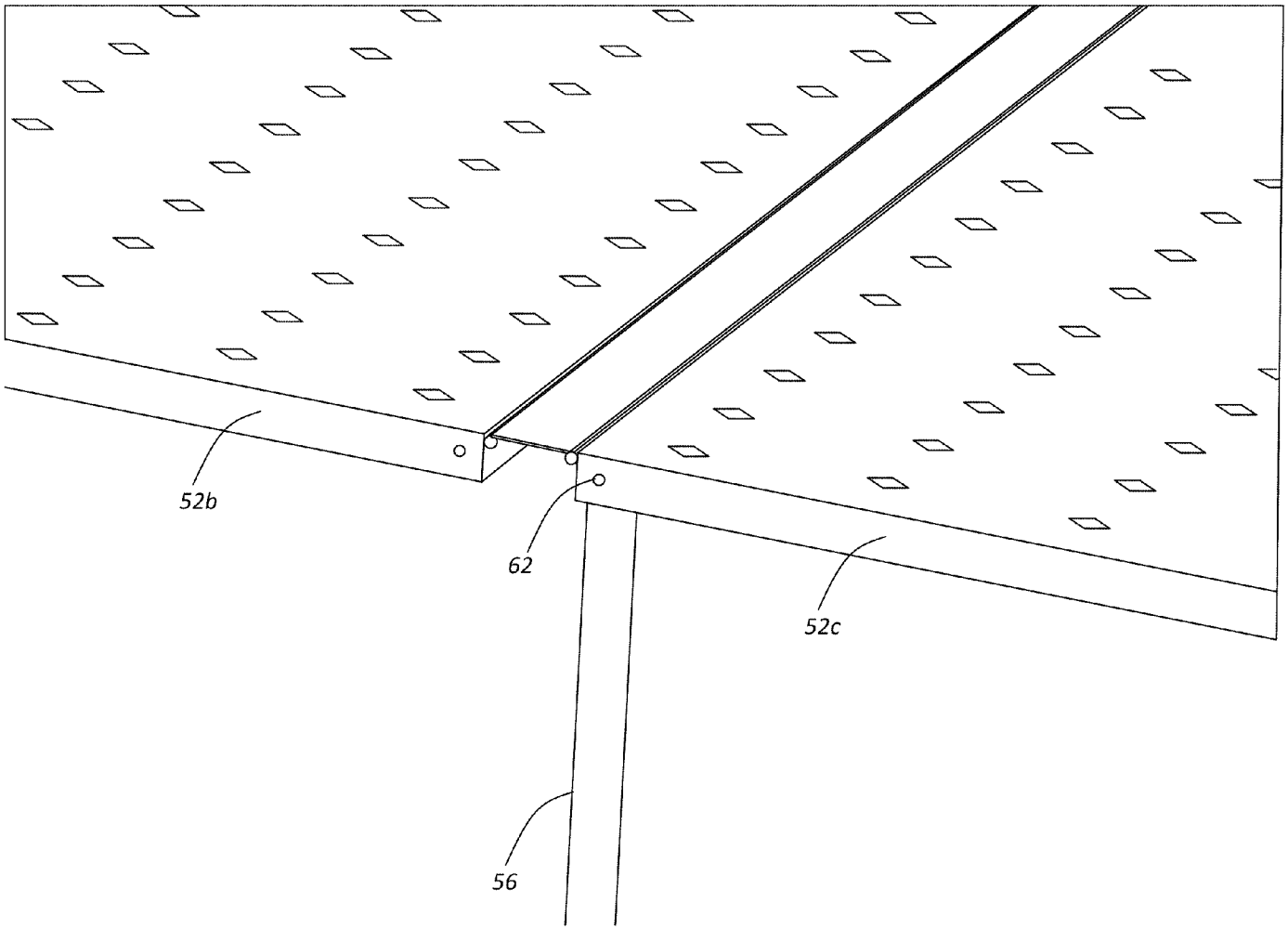
FIG. 15 is a close-up schematic perspective diagram illustrating a folding joint of the frame assembly of FIG. 13.
Figure 16:
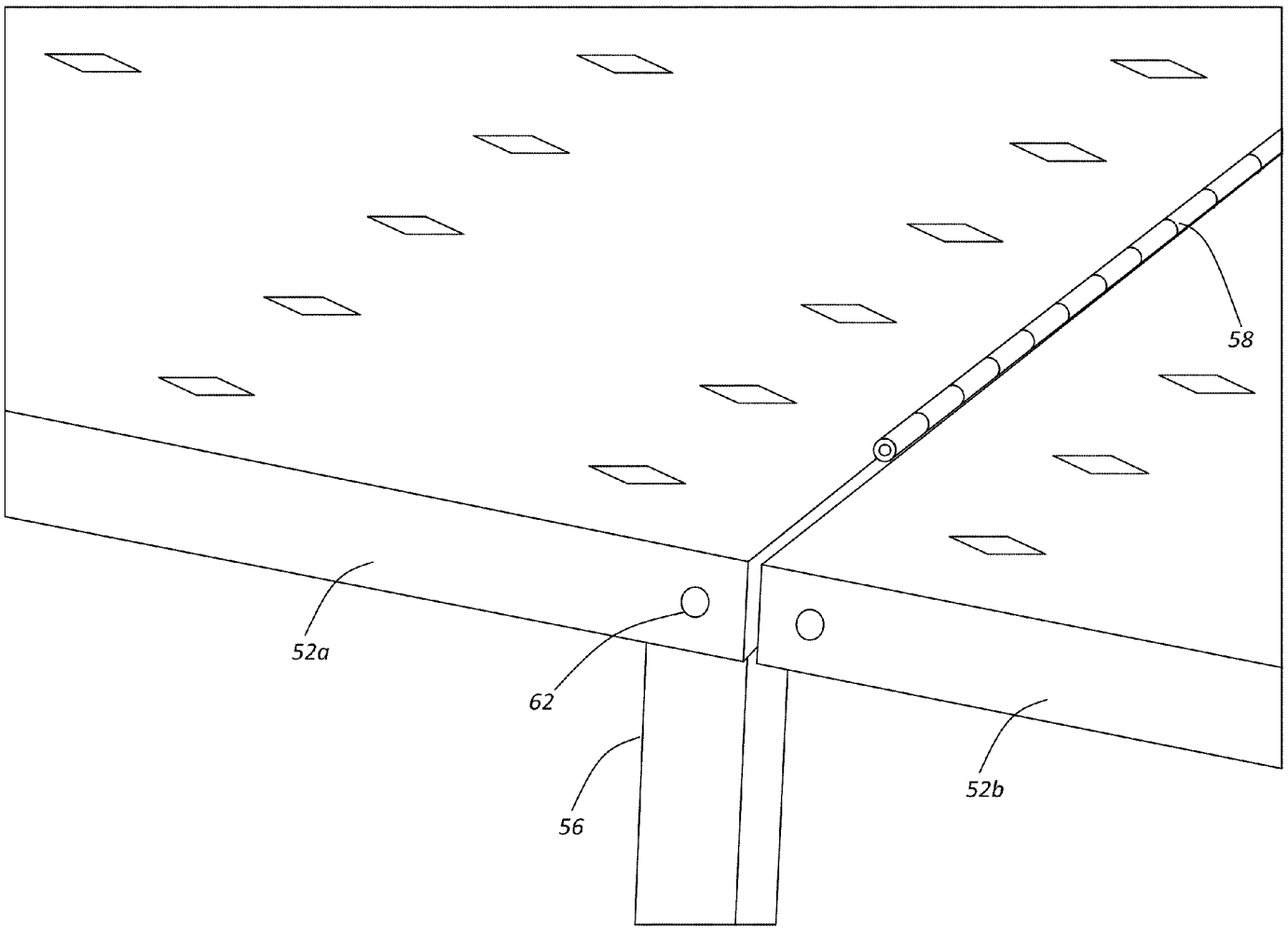
FIG. 16 is a close-up schematic perspective diagram illustrating a rotating hinge of the frame assembly of FIG. 13.
Figure 17:
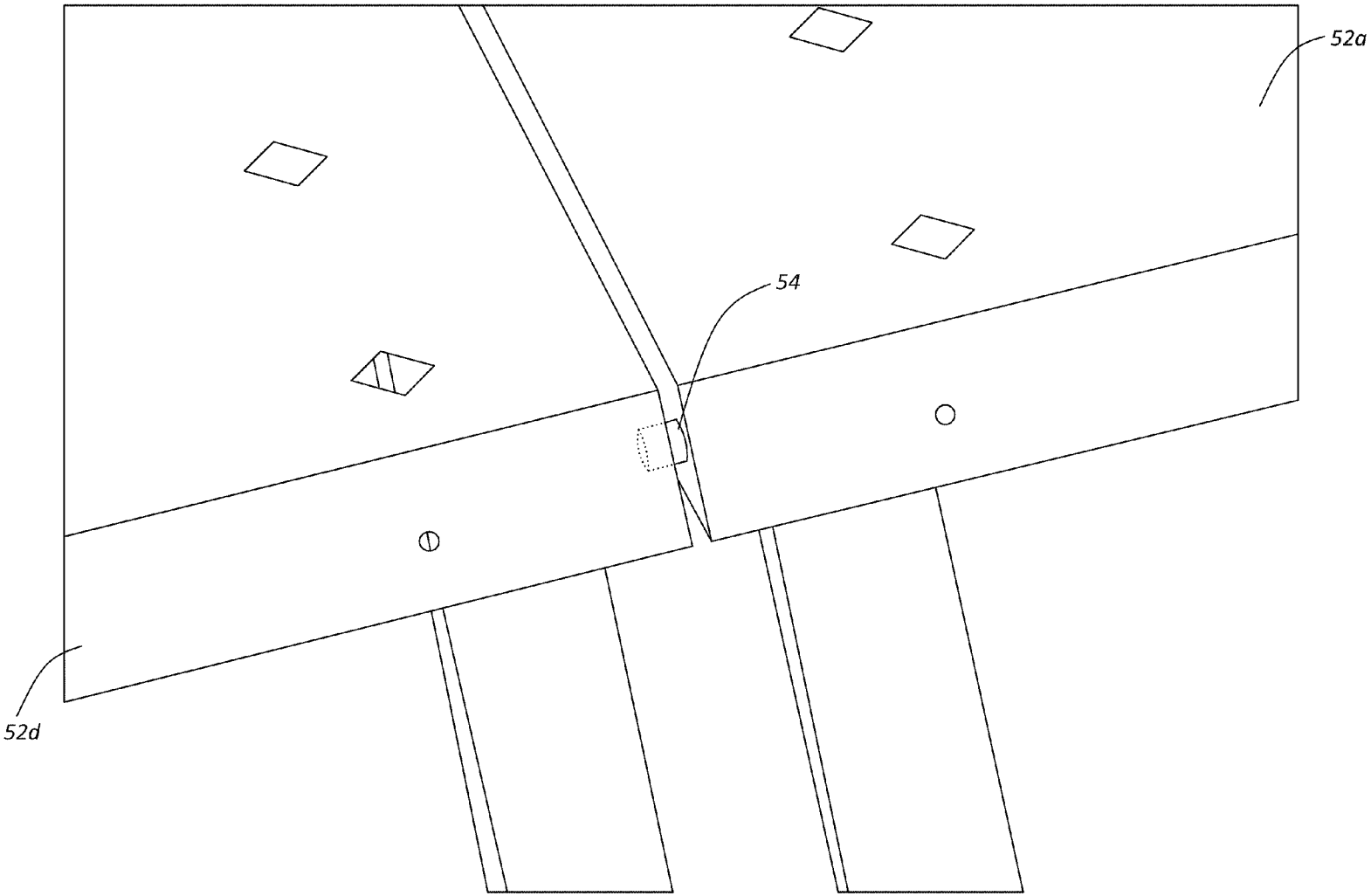
FIG. 17 is a close-up schematic perspective diagram illustrating a connecter between subassemblies of the frame assembly of FIG. 13.
Figure 18:
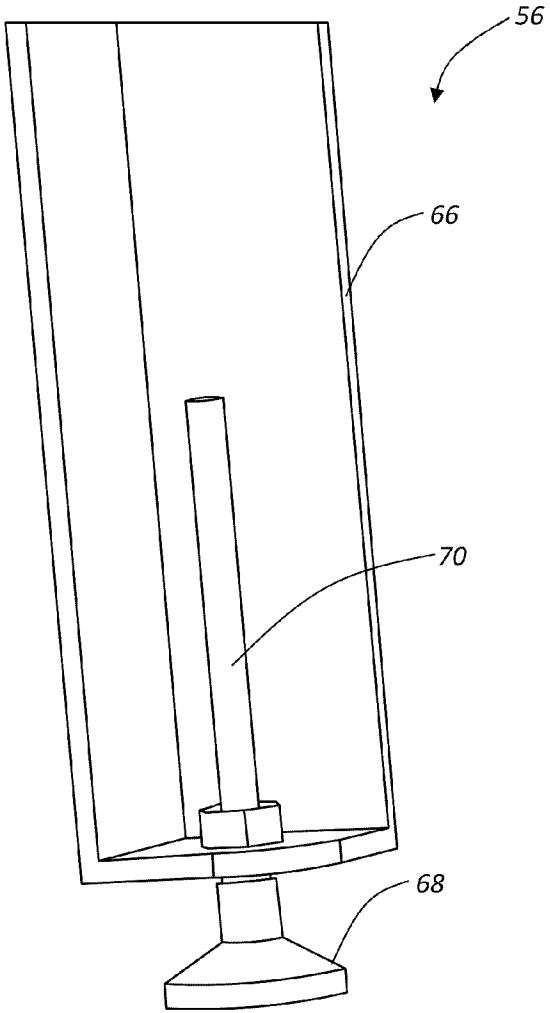
FIG. 18 is a schematic perspective diagram illustrating a deployable leg for the frame assembly of FIG. 13.

FIGS. 14-15 illustrate close-up views of the hinge 58 and the folding joint 60. Specifically, both the hinge 58 and the folding joint 60 are configured to enable rotational motion of the subassemblies 52 relative to one another for stowing. The hinge 58 enables the subassemblies 52*a*, 52*d* to fold over onto the subassemblies 52*b*, 52*e* and the folding joint 60 enables the subassemblies 52*c*, 52*f* to fold under the subassemblies 52*b*, 52*e*. FIG. 18 illustrates a close-up view of a bottom of the deployable leg 56. Specifically, the deployable leg 56 includes an elongated member 66 with a base 68 disposed through a movable rod 70 disposed in the elongated member 66. The deployable leg 56 can be adjusted by moving or rotating the movable rod 70 to a desired position.

The frame assembly 50 is illustrated without the one or more deployable paddle structures 20. In one exemplary embodiment, the subassemblies 52*a*, 52*d* are configured to rest on a conventional piece of furniture for support. Alternatively, the deployable legs 56 can also be used to provide the functionality of the one or more deployable paddle structures 20.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A piece of furniture with a removable bed assembly, comprising:

an existing piece of furniture;

a frame assembly; and one or more deployable paddle structures disposed at an end of the frame assembly, wherein the one or more deployable paddle structures are configured to interconnect the frame assembly with the existing piece of furniture and wherein the existing piece of furniture provides support for the frame assembly;

wherein the existing piece of furniture is separate and not permanently connected to the frame assembly, wherein the frame assembly comprises a plurality of subassemblies, and wherein the one or more deployable paddle structures are hingedly connected to one of the plurality of subassemblies.

2. The piece of furniture with a removable bed assembly of claim 1, further comprising:

a deployable mattress supported by the frame assembly.

3. The piece of furniture with a removable bed assembly of claim 2, wherein the deployable mattress comprises one of an air mattress, a foam mattress, a filled mattress, an innerspring mattress, a water mattress, and a pad.

4. The piece of furniture with a removable bed assembly of claim 1, further comprising:

a plurality of legs movably disposed to the frame assembly, wherein the plurality of legs are configured for adjustable height of the frame assembly based on the existing piece of furniture.

5. The piece of furniture with a removable bed assembly of claim 1, wherein the plurality of subassemblies are rotatably interconnected to one another thereby enabling the frame assembly to deploy into a deployed configuration and to store in a stowed configuration.

6. The piece of furniture with a removable bed assembly of claim 1, wherein the plurality of subassemblies connected to an additional frame assembly with an additional plurality of subassemblies to form a larger deployable bed.

7. The piece of furniture with a removable bed assembly of claim 1, wherein the existing piece of furniture comprises any of a sofa, a chair, and a love seat, and wherein the existing piece of furniture does not include a deployable sofa bed at a time of manufacture.

* * * * *